US008028933B2

(12) United States Patent
Friis

(10) Patent No.: US 8,028,933 B2
(45) Date of Patent: Oct. 4, 2011

(54) SHOWER ADDITIVE DISPENSER

(76) Inventor: Nils Friis, Gulf Stream, FL (US)

( * ) Notice: Subject to any disclaimer, the term of this patent is extended or adjusted under 35 U.S.C. 154(b) by 642 days.

(21) Appl. No.: 11/857,843

(22) Filed: Sep. 19, 2007

(65) Prior Publication Data

US 2008/0121737 A1 May 29, 2008

Related U.S. Application Data

(60) Provisional application No. 60/861,227, filed on Nov. 27, 2006.

(51) Int. Cl.
*B05B 7/26* (2006.01)
*B05B 7/28* (2006.01)

(52) U.S. Cl. ..... 239/314; 239/318; 239/310; 4/605

(58) Field of Classification Search ..... 239/310, 239/314, 318, 145, 326; 4/223, 231, 605
See application file for complete search history.

(56) References Cited

U.S. PATENT DOCUMENTS 2,663,040 A * 12/1953 Leckler ..... 401/206
2,743,913 A 5/1956 Gundlach
3,003,703 A 10/1961 Lambton
3,052,417 A * 9/1962 Daniel ..... 239/314
3,075,557 A 1/1963 Kuriluk
3,198,437 A * 8/1965 Faglie ..... 239/309
3,556,502 A 1/1971 Rheinlander et al.
4,019,658 A 4/1977 Consaul
4,027,822 A 6/1977 Usher
4,121,773 A 10/1978 Headen et al.
4,131,232 A 12/1978 Pollinzi
4,214,675 A * 7/1980 Schmit ..... 222/83
4,218,013 A 8/1980 Davison
4,219,158 A 8/1980 Lacy
4,225,085 A 9/1980 Headen et al.
4,358,056 A 11/1982 Greenhut et al.
4,396,155 A 8/1983 Betsinger et al.
4,432,105 A 2/1984 Pitroda
4,463,462 A 8/1984 Greenhut
4,607,793 A 8/1986 Eberle
4,651,930 A 3/1987 Mahaha, Jr.
4,840,311 A 6/1989 Shamblin
4,881,575 A 11/1989 Smith
4,901,765 A 2/1990 Poe
4,905,904 A * 3/1990 Ohara et al. ..... 239/284.1
5,071,070 A 12/1991 Hardy
5,174,503 A 12/1992 Gasaway
5,274,858 A 1/1994 Berry
5,305,476 A 4/1994 Ohyama et al.
5,333,789 A 8/1994 Garneys
5,339,469 A 8/1994 Gilles
5,356,076 A 10/1994 Bishop
(Continued)

FOREIGN PATENT DOCUMENTS

DE 2408718 5/1975
(Continued)

*Primary Examiner* — Dinh Nguyen
(74) *Attorney, Agent, or Firm* — Robert M. Schwartz; Alfred K. Dassler

(57) ABSTRACT

A shower additive dispenser assembly including an arm member. A receptacle is mounted to the arm member. A body member has a cavity formed therein for retaining a fluid, the body member is removably mounted to the receptacle. A microporous flow restrictor is disposed at the body member. The microporous flow restrictor is configured for allowing the fluid to exit the body member.

20 Claims, 8 Drawing Sheets

U.S. PATENT DOCUMENTS

| | | | | |
|---|---|---|---|---|
| 5,562,248 | A | 10/1996 | Khalifka | |
| 5,716,005 | A | 2/1998 | McMahan | |
| 5,957,379 | A | 9/1999 | McMorrow et al. | |
| 6,006,374 | A | 12/1999 | Winnett et al. | |
| 6,178,564 | B1 * | 1/2001 | Leonard et al. | 4/223 |
| 6,336,571 | B1 | 1/2002 | Chibret et al. | |
| 6,859,955 | B2 | 3/2005 | Hudson | |
| 6,923,384 | B2 | 8/2005 | Cernik | |
| 6,926,212 | B1 | 8/2005 | Glass | |
| 6,991,184 | B2 | 1/2006 | Romaine | |
| 7,021,494 | B2 | 4/2006 | Mazooji et al. | |
| 7,191,960 | B1 | 3/2007 | Schrock et al. | |
| 7,201,331 | B2 | 4/2007 | Bertrand | |
| 2002/0158033 | A1 * | 10/2002 | Chen | 211/103 |
| 2006/0157589 | A1 | 7/2006 | Joseph et al. | |

FOREIGN PATENT DOCUMENTS

| | | | |
|---|---|---|---|
| DE | 19749514 | A1 | 5/1999 |

* cited by examiner

SHOWER ADDITIVE DISPENSER

CROSS-REFERENCE TO RELATED APPLICATIONS

This application claims the benefit of U.S. Provisional Application Ser. No. 60/861,227, filed on Nov. 27, 2006, entitled Shower Additive Dispenser, the prior application is herewith incorporated by reference in its entirety.

BACKGROUND OF THE INVENTION

1. Field of the Invention

The present invention pertains to chemical dispensers. More specifically, to an additive dispenser attachable to a showerhead or a shower pipe.

2. Description of the Related Art

Attachment devices for showerheads are well known and provide a method for dispensing an additive such as aromatic oil or medication into shower water. The devices previously proposed either lack the ability to accurately control the flow rate of the additive, aromatic oil or medication, into the water, or those devices that provide such control generally are of very complex construction and, hence, are too expensive to manufacture. Furthermore, they are cumbersome to use and take up considerable space.

For instance, U.S. Pat. No. 4,358,056 discloses a method to control the rate by which the additive is introduced into the water prior to the water entering the showerhead, i.e. the additive is mixed with water under pressure. However, the device requires the use of a mixer coupling and three different valves. An additional disadvantage of this and many similar devices described in the prior art is that the additive is mixed with the water prior to the water entering the showerhead. Most commercial showerheads are fitted with various parts made of synthetic rubber, and additives such as aromatic oils cause significant swelling of these rubber parts, thus causing damage to the showerhead.

U.S. Pat. No. 4,131,232 and 6,923,384 disclose two very similar liquid additive dispensing devices in which the additive is added to the shower water after the water exits the showerhead. Both devices use gravity as the force to cause the flow of the additive from a reservoir into the shower water. However, with both devices the additive flows into the water stream as discrete droplets, which is undesirable in many applications. For instance, in one potential type of application, namely aromatherapy, the amount of aromatic oil that is needed for a shower of typical duration is extremely small, generally of the order of less than 0.5 ml per minute or approximately 10 drops per minute. Therefore, if the oil is added in the form of discrete droplets, the aroma effect will be very intermittent, with a sudden burst of strong aroma followed by a period of several seconds with no aroma, a result, which is generally undesirable.

Furthermore, none of the above-mentioned patents disclose a specific method for controlling the flow rate of oil. Simple valves such as needle valves or pinch valves are not capable of providing adequate flow control at the very low flow rates that are required to dispense aroma oils or other additives such as medication. Electronically operated valves may provide adequate control of the flow rate, but such valves are too expensive for most consumer applications. Accurate and reliable control of the additive flow rate is important in many applications. For instance, in the case where bath oil or essential oil is added to shower water to generate an aroma effect, there is a need to control the flow rate because the intensity of the aroma is influenced by several factors such as the type of oil and the water temperature and the preference for different aroma intensities (strong, medium, mild) varies among users. The need to control the additive flow rate is not limited to essential oils and bath oils, but also applies to other additives such as medications.

The present invention provides for a shower additive dispenser which delivers a continuous, i.e. non-intermittent flow of an additive to shower water at extremely low flow rates, and which is capable of controlling the flow rate over a wide range using only one moving part.

SUMMARY OF THE INVENTION

It is accordingly an object of the invention to provide a shower additive dispenser, which overcomes the above-mentioned disadvantages of the heretofore-known devices of this general type and which provides a shower additive dispenser that is of simpler construction more versatile and easier to use.

The present invention provides for a shower additive dispenser which delivers a continuous, i.e. non-intermittent flow of an additive to shower water at extremely low flow rates, and which is capable of controlling the flow rate over a wide range using only one moving part.

With the foregoing and other objects in view there is provided, a shower additive dispenser assembly including an arm member. A receptacle is mounted to the arm member. A body member has a cavity formed therein for retaining a fluid, the body member is removably mounted to the receptacle. A microporous flow restrictor is disposed at the body member. The microporous flow restrictor is configured for allowing the fluid to exit the body member.

In accordance with another feature of the invention, the receptacle is pivotably mounted to the arm member for controlling a rate flow of the fluid by defining the angle of the body member.

In accordance with an added feature of the invention, the body member has an end with an opening formed therein. The opening is sealed with a foil. The receptacle has a piercing device configured to pierce the foil when the body member is mounted to the receptacle.

In accordance with an additional feature of the invention, the piercing device has a cross-shaped cross-section for allowing air to escape the body by flowing along the piercing device.

In accordance with yet an additional feature of the invention, the body member is mounted to the receptacle with a bayonet-type connection.

In accordance with a further feature of the invention, the microporous flow restrictor is hydrophobic.

In accordance with yet another feature of the invention, the microporous flow restrictor is selected from the group consisting of polyethylene and polypropylene.

In accordance with yet an additional feature of the invention, the arm member is telescopic and is configured to be mounted to a shower supply pipe.

With the objects of the invention in view, there is also provided in combination with a receptacle having a piercing device a shower additive dispenser. The dispenser including a body member having a cavity formed therein for retaining a fluid. The body member is configured for being removably mounted to the receptacle. The body member has an aperture formed therein and communicates with the cavity. The aperture is configured for accepting the piercing device. A seal seals the aperture. A microporous flow restrictor is disposed at the body member and is constructed for allowing the fluid to flow from the cavity.

In accordance with still a further feature of the invention, the seal is a foil affixed to the body member.

In accordance with yet still a further feature of the invention, the body member has tabs for mounting the body member to the receptacle.

In accordance with still another feature of the invention, the microporous flow restrictor is cylindrical. The microporous flow restrictor has a portion disposed in the cavity and a portion projecting from the body member.

Other features which are considered as characteristic for the invention are set forth in the appended claims.

Although the invention is illustrated and described herein as embodied as a shower additive dispenser for delivering an additive to shower water, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
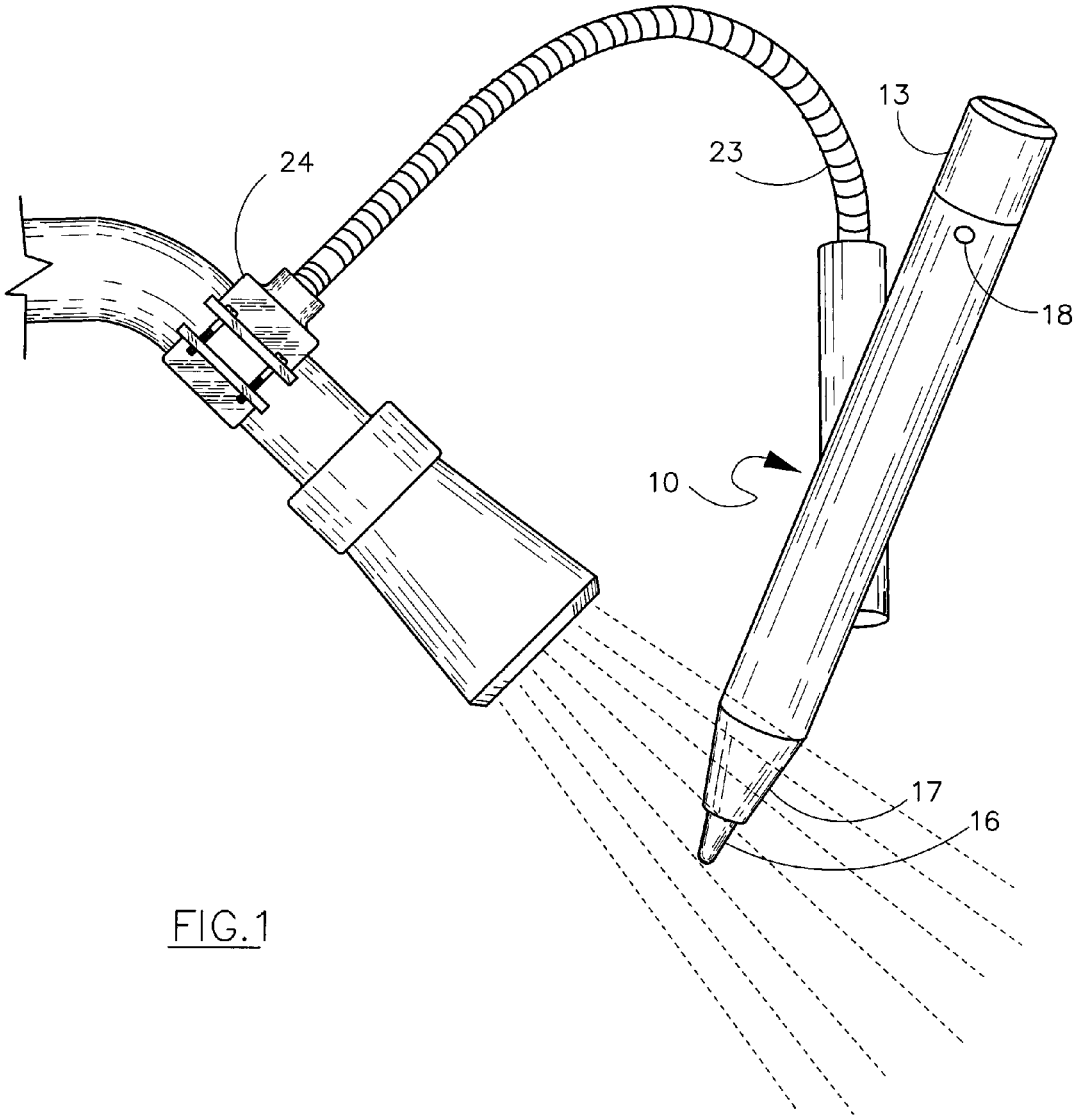
FIG. 1 is a perspective view of the shower additive dispenser according to the invention mounted on shower supply pipe.
Figure 2:
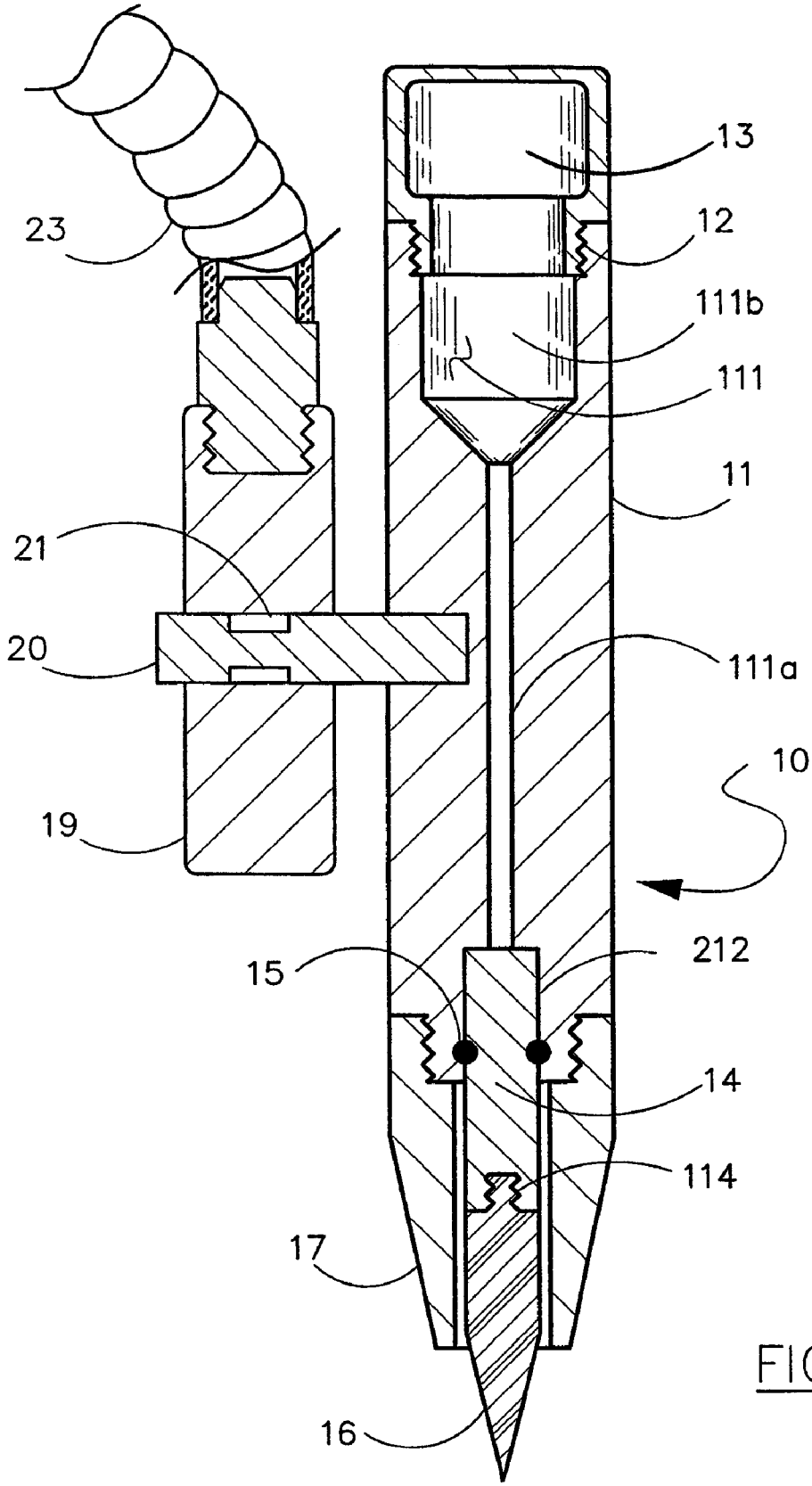
FIG. 2 is an axial cross-sectional view of the shower additive dispenser according to the invention.

With reference to FIGS. 1 through 4, a new and improved shower additive dispenser 10 will now be described. FIG. 2, shows that the dispenser 10 includes a cylindrical body member 11 having an axial bore 111. One end of the cylindrical body member 11 has a thread portion 12, which fits the threads on a neck of an additive reservoir 13. The other end of the cylindrical body member 11 has a circular opening 212 connected to the axial bore 111. The circular opening 212 has a diameter slightly larger than a diameter of a micro-porous flow restrictor 14. Thus, the flow restrictor 14 can be inserted in to the circular opening 212 of body member 11. The body member 11 is provided with an annular seal groove in the circular opening 212 to seat an o-ring 15, which serves to prevent leakage through the gap between the body member 11 and the flow restrictor 14. The axial bore 111 through the body member 11 includes two sections with different diameters. At one end of body member 11, the bore 111 has a relatively large diameter 111*b*, and thus provides a cavity 111*b* with a volume that is approximately the same as the volume of the reservoir 13. The other and longer section 111*a* of the bore 111 has a diameter that is relatively small, though sufficiently large to allow for air bubbles to escape when oil flows through the bore. For this purpose the minimum size of the diameter of the longer section 111*a* of the bore 111 is approximately ⅛ inch, and preferably 5/32 inch. For reasons explained in more detail below, it is desirable that the diameter of the longer section 111*a* of the bore 111 is no larger than necessary to allow air bubbles to escape when the additive flows through the bore 111.

The micro-porous flow restrictor 14 is a cylinder, which is made of sintered particles. The material of construction may be a plastic such as polyethylene or polypropylene, a ceramic or a metal such as bronze or stainless steel. Micro-porous flow restrictors 14 made from plastic offer the advantage of being inexpensive. In addition, when the flow restrictor 14 is constructed from a hydrophobic material such a polyethylene or polypropylene, the flow restrictor 14 can be exposed directly to the shower water without affecting the flow of additive through the flow restrictor 14. However, micro-porous flow restrictors 14 made of plastic are less durable and also become stained from color bodies commonly present in essential oils. Thus, flow restrictors 14 made from plastic are more suitable for use in a disposable device such as described below in the second embodiment of the present invention. Flow restrictors 14 made from metals or ceramics are preferred for use in devices that are intended for repeated use such as the device described in the first embodiment of the present invention. However, in contrast to flow restrictors 14 made from hydrophobic plastics, flow restrictors 14 made from metals and ceramics generally should not be exposed directly to the shower water because the presence of water on the surface of these materials may interfere with the flow of additive through the flow restrictor 14.

The rate by which the additive flows through the flow restrictor 14 is determined by the porosity of the flow restrictor 14, the dimensions and geometric shape of the flow restrictor 14, and the hydrostatic pressure exerted by the fluid column above the flow restrictor 14. In addition, the flow rate is also determined by how far the flow restrictor 14 extends into body member 11. For the purposes of this invention it has been determined that the pore size of the flow restrictor 14 should be in the range of 0.5 to 90 microns and more preferably in the range of 5 to 35 microns for flow restrictors 14 with a diameter between ⅛ inch and ¼ inch and a length of between ½ inch and 2 inches. The end of the flow restrictor 14 which projects from the body member 11 has a threaded bore 114 which is adapted to fit the threading of a tip 16, which is also referred to as the liquid dispensing tip. The end of tip 16, which is attached to flow restrictor 14, has a diameter, which is substantially exactly the same as the diameter of the flow restrictor 14. The tip 16 and the flow restrictor 14 are attached to each other seamlessly, so that the liquid additive, which permeates through the surface of the flow restrictor 14, flows downward over the surface of tip 16. The opposite end of tip 16 is shaped like a cone. The tip 16 may be fabricated from a variety of materials including, but not limited to metals, plastics and ceramics. The surface texture of tip 16 should be slightly roughened so as not to be smooth. This allows that the liquid additive that flows downward on its surface to be a continuous thin film rather than discrete droplets.

A cap 17 is provided to cover the end of the micro-porous flow restrictor 14 which projects from the body member 11, so that it does not become exposed to the shower water, which could otherwise interfere with the permeation of the additive through the flow restrictor 14. One end of the cap 17 has a threaded opening that is fitted to a male threading on the body member 11. The other end has a narrow aperture through which the tip 16 protrudes.

Figure 3:
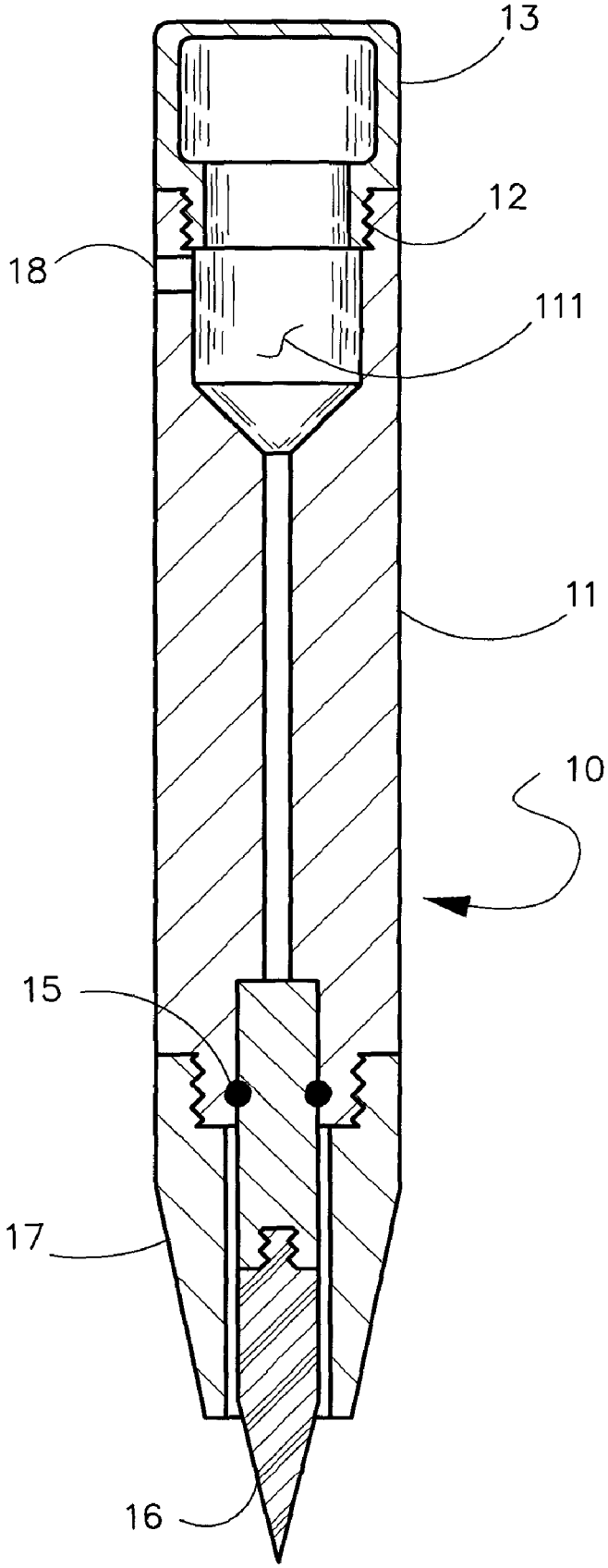
FIG. 3 is another axial cross-sectional view of the shower additive dispenser according to the invention.

As shown in FIGS. 1 and 3, the body member 11 is provided with a small aperture 18, which serves as a vent to allow air into the upper cavity 111*b* of body member 11 when the liquid additive flows out of the device. The exact location of aperture 18 will be discussed in further detail below.

As shown in FIG. 2, the body member 11 is attached to mount member 19 via cylindrical pin 20. One end of pin 20 is affixed permanently to the body member 11. The mount member 19 is provided with an aperture, which is adapted to fit the pin 20.

Figure 4:
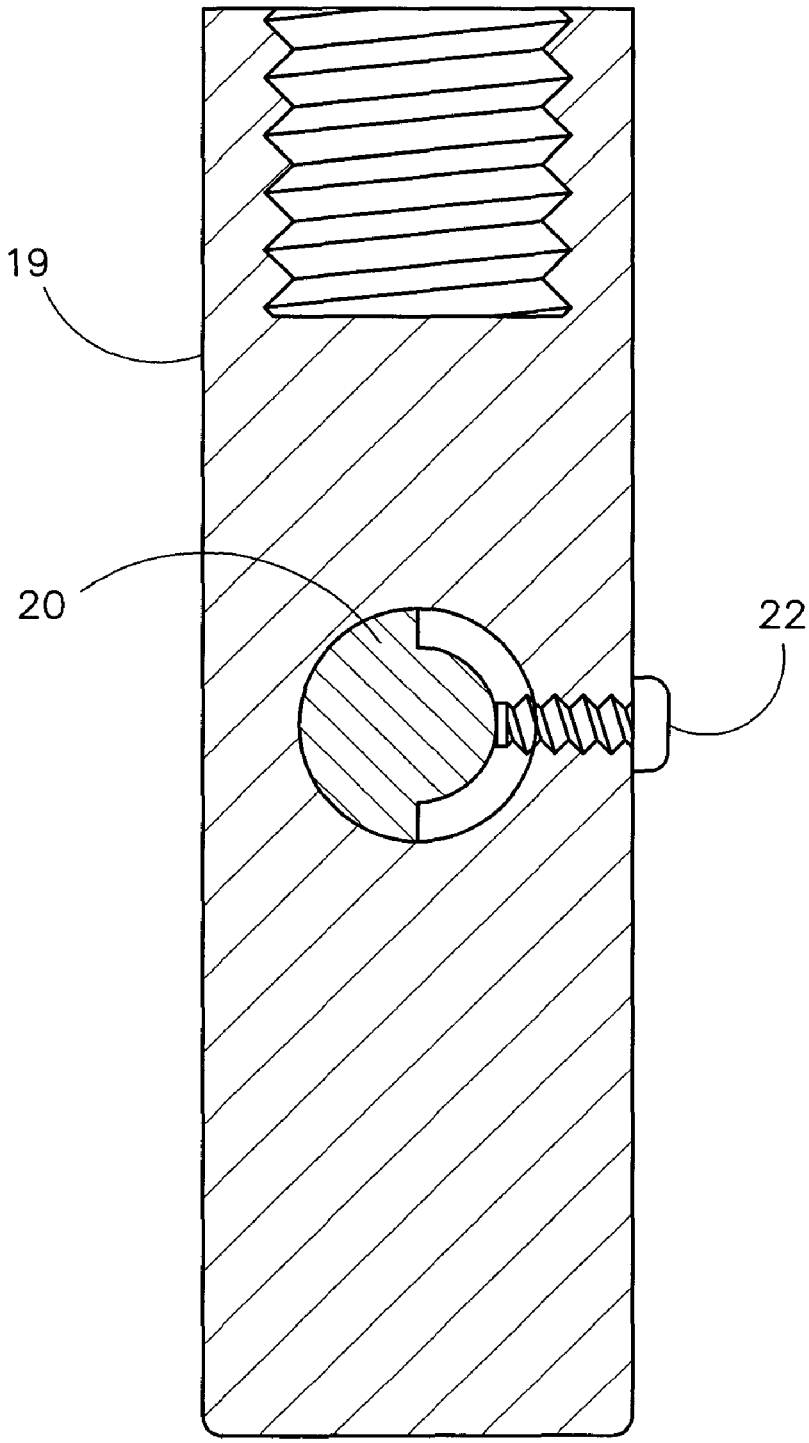
FIG. 4 is an axial cross-sectional view of the fourth body member of the shower additive dispenser according to the invention.

The pin 20 is provided with a groove 21, which circumscribes the pin 20 by approximately 180 degrees. As depicted in FIG. 4, a threaded hole in mount member 19 is configured to fit a threaded screw 22, which fits into the groove 21. Thus, when the screw 22 is screwed into the threaded aperture of mount member 19, it limits the degree to which body member 11 can be rotated relative to mount member 19. Thus, when body member 11 and the mount member 19 are initially aligned with both members in a vertical position, body member 11 can be rotated only 180 degrees relative to mount member 19, that is from an initial position in which the tip 16 points directly upwards and the reservoir 13 points downwards to the exact opposite position, or vice versa. When body member 11 is positioned so that socket 12 faces downward, the reservoir 13 can be attached to body member 11, and by subsequently turning body member 11 upside down, the liquid additive is transferred from the reservoir 13 to the upper cavity 111*b* of body member 11 without spilling any material. In this regard it is important to point out that aperture 18 should be located in such a position that the liquid does not flow out of aperture 18 when it is transferred from the reservoir 13 to the upper cavity 111*b* of body member 11. For instance, if the dispenser 10 is set up in such a way that it must be rotated counter-clockwise in order to transfer the additive from the reservoir 13 to the upper cavity 111*b* of body member 11, then aperture 18 should be disposed so that it faces the direction of movement of the lower portion of body member 11.

As is shown in FIGS. 1 and 2, mount member 19 is affixed to a piece of flexible tubing or arm member 23, which at the other end is attached to the shower pipe via clamp 24. The flexible tubing allows for the movement of the dispenser 10 into and out of the shower water stream.

When using the dispenser 10, the body member 11 is turned to a vertical position with socket 12 pointing downwards. The reservoir 13, loaded with the liquid additive, is screwed into socket 12 and body member 11 is rotated to a position where the tip 16 points downward. The rotation causes the liquid additive to flow from reservoir 13 into the upper cavity 111*b* of body member 11 and subsequently through the narrow bore 111*a* of body member 11, which communicates with flow restrictor 14. When the liquid permeates the flow restrictor 14, it appears as a thin film on the exterior surface of the flow restrictor 14. The film gradually flows downwards to cover the entire surface of the tip 16. When the tip 16 is inserted into the shower water stream, the film is continuously washed away, and the additive is dispersed into the water stream.

The liquid additive flows through flow restrictor 14 due to the hydrostatic pressure exerted by the column of fluid above the flow restrictor 14. When the liquid is transferred into the cavity 111*b* of the body member 11, most of the liquid is located in the upper cavity 111*b* of the body member 11, and only a small portion of the liquid occupies the space in the narrow section of the bore 111*a* through the body member 11. Thus, as the liquid is dispensed, the hydrostatic pressure and, therefore, the flow rate remains relatively constant until most of the liquid has been consumed, because the height of the liquid column in the upper cavity 111*b* is relatively small compared to the total height of the column. That is why the diameter of the narrow bore 111*a* through the body member 11 should not be any larger than the minimum required to allow air bubbles to escape when the device is filled with liquid additive. In the first embodiment of the present invention, the volume of the large cavity 111*b* in the body member 11 accounts for 50 to 90% and more preferably for 75 to 85% of the total internal volume of body member 11. The length of the narrow bore 111*a* in the body member 11 is between 1 and 8 inches and more preferably between 2 and 6 inches.

The flow rate through the flow restrictor 14 is at its maximum when the dispenser 10 is in a vertical position with the tip 16 pointing downward. To reduce the flow rate, the body member 11 is rotated so that it forms an angle with the mount member 19, which is held in a vertical position. The tilting of the body member 11 reduces the effective hydrostatic pressure exerted by the liquid column above the flow restrictor 14. For instance, if body member 11 is tilted to a position to form a 45-degree angle with the mount member 19, the flow rate is reduced to approximately 70% of the flow rate achieved when the body member 11 is held in a vertical position. At a 60-degree angle, the flow rate is reduced to approximately 50% and so forth.

Any liquid additive that remains in the dispenser 10 after the shower water has been turned off can be returned to reservoir 13 and thus saved, simply by rotating the dispenser, so that the reservoir 13 is facing downwards. This will cause the liquid to drain from the dispenser into the reservoir 13.

Figure 5B:
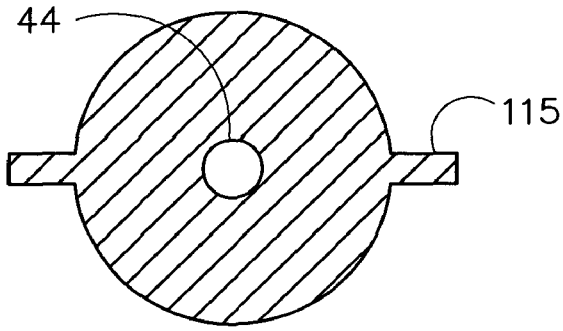
FIG. 5*b* is a radial cross-sectional view of the present invention, the section taken on the line A-A in FIG.
Figure 5A:
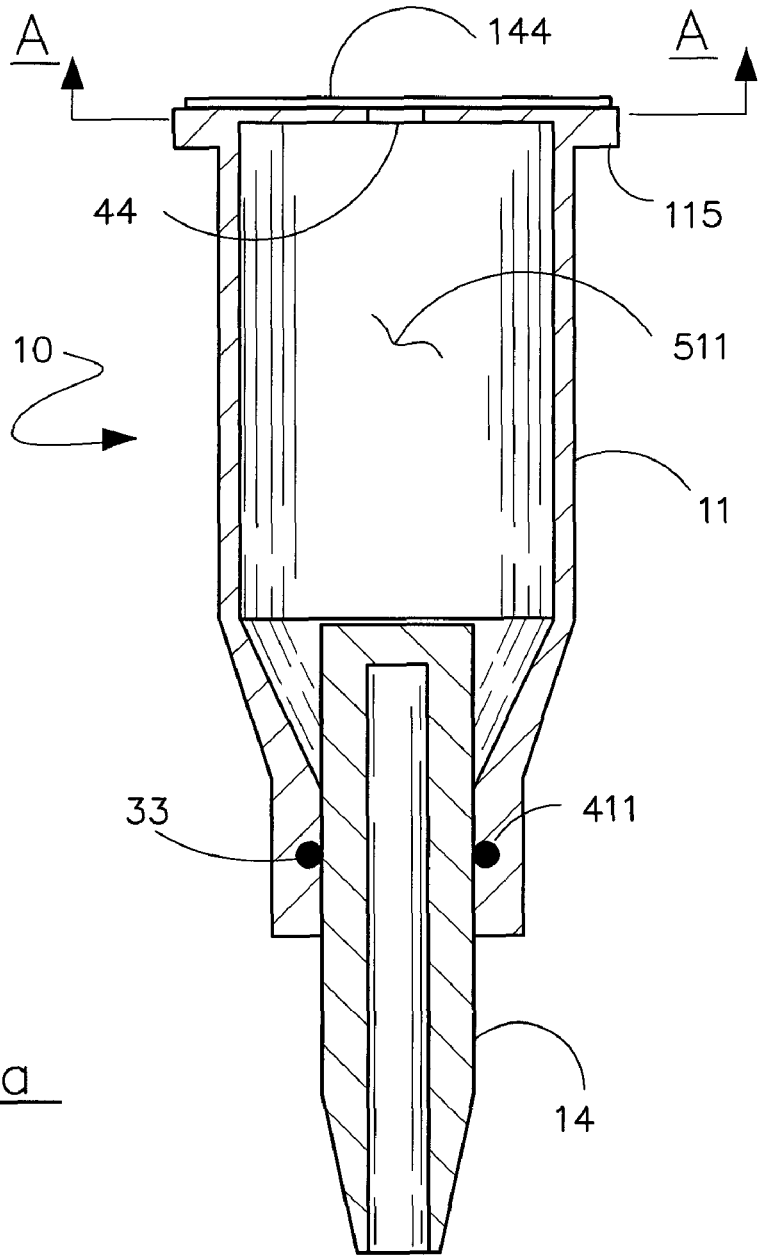
FIG. 5*a* is an axial cross-sectional view of another embodiment of the shower additive dispenser according to the invention.

With reference to FIGS. 5*a* and 5*b*, 6*a* through 6*d*, and 7, the preferred embodiment of the present invention, will now be described. As is shown in FIG. 5*a*, the dispenser 10 has a hollow body member 11, which in one end has a circular opening with a diameter slightly larger than the diameter of the micro-porous flow restrictor 14, so that the flow restrictor 14 can be inserted in to the bore of body member 11. The body member 11 is provided with an annular seal groove 411 to seat o-ring 33, which serves to prevent leakage through the gap between the body member 11 and the flow restrictor 14. The other end of the body member 11 is provided with an aperture 44, which serves as a vent to allow air into the device so that the liquid contained in body member 11 can flow through the micro-porous flow restrictor 14. Prior to use, the aperture 44 is covered by an adhesive foil 144, which prevents the additive from flowing out through the micro-porous flow restrictor 14. Alternatively, it is possible that the body member 11 is not provided with a through aperture 44. In this case, the end of the body member 11 may be formed with a score or thinning which defines a perimeter. The perimeter defines a panel or button that is displaced when body member 11 is inserted into the receptacle 116. This creates the aperture 44 defined by the perimeter.

Figure 7:
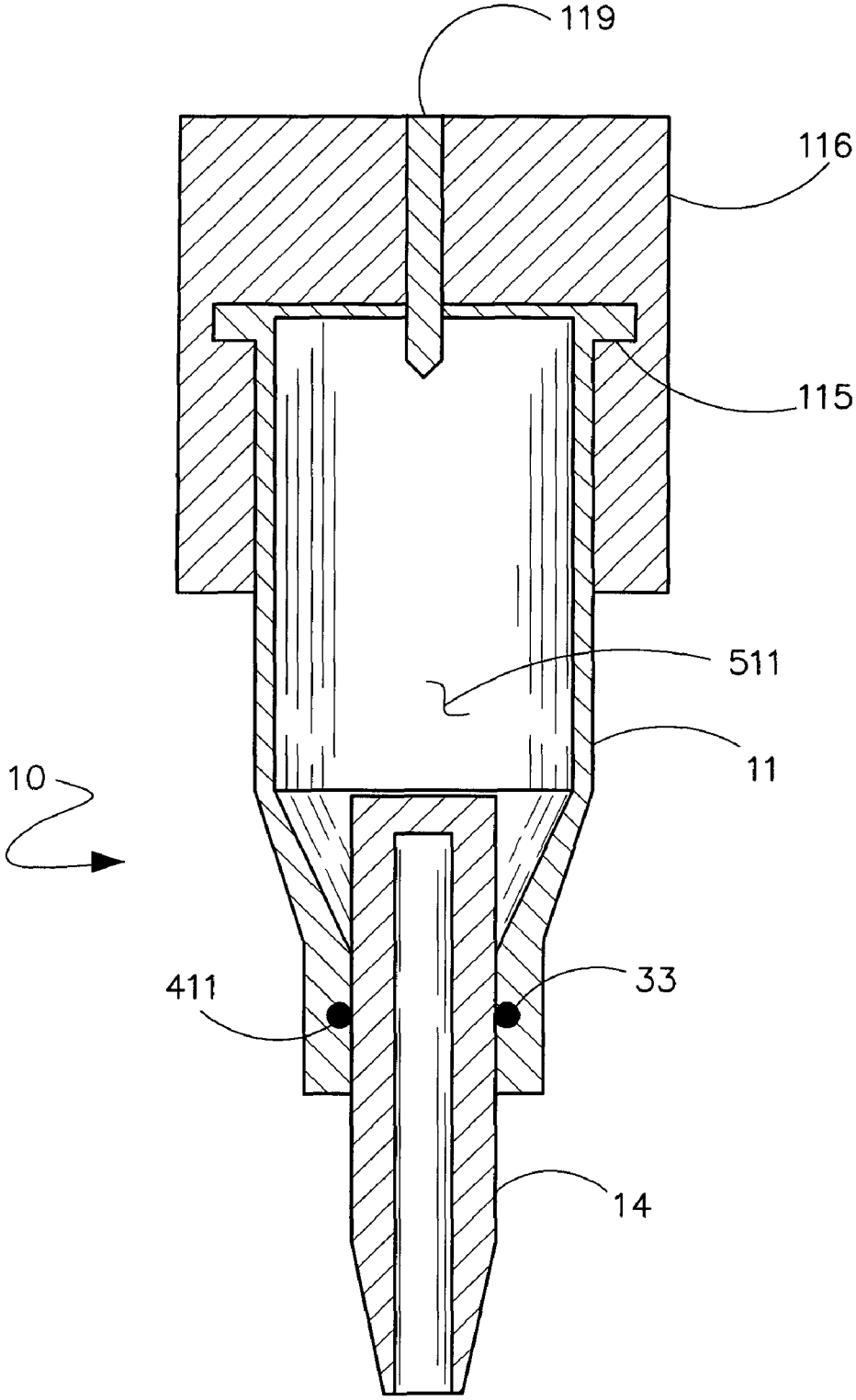
FIG. 7 an axial cross-sectional view showing the dispenser of the second embodiment of the present invention inserted into the receptacle.

As mentioned above, the micro-porous flow restrictor 14 is made of sintered particles and can be fabricated from a range of materials including plastics, metals, and ceramics. Being relative inexpensive, plastic is the preferred material for use with the device described in the preferred embodiment of the present invention, as it is used only once. The micro-porous flow restrictor 14 is cylindrical in shape and can be either a solid cylinder or a hollow cylinder closed on one end (blind ended flow restrictor) as depicted in FIG. 5*a* and FIG. 7.

Figure 6D:
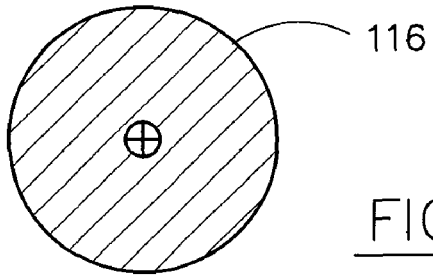
FIG. 6*d* is a radial cross-sectional view of the receptacle shown in FIG. 6*b*, the section taken along the line C-C in FIG. 6*b;*
Figure 6C:
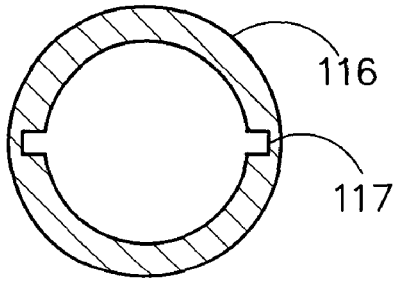
FIG. 6*c* is a radial cross-sectional view of the receptacle, the section taken along the line B-B in FIG. 6*a;*
Figure 6B:
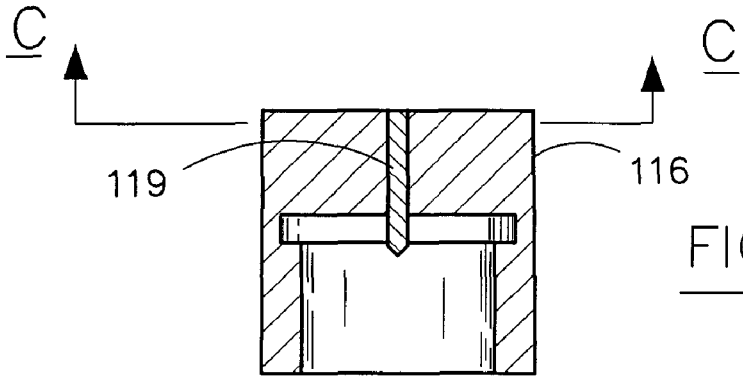
FIG. 6*b* is an axial cross-sectional view of the receptacle shown in FIG. 6*a* in which the receptacle has been rotated 90 degrees from the position shown in FIG. 6*a;*
Figure 6A:
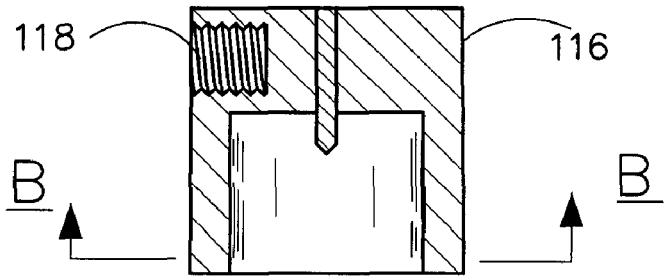
FIG. 6*a* is an axial cross-sectional view of a receptacle fitted to receive the device shown in FIG. 5*a;*

As shown in FIGS. 5*a* and 5*b*, the body member 11 is provided with tabs 115, which fit into slots 117 in the receptacle 116 in a bayonet type connection shown in FIGS. 6*a* through 6*d*. Receptacle 116 has a threaded aperture 118, so that it can be attached to a piece of flexible tubing, the other end of which can be attached to the shower pipe in a similar fashion as shown in FIG. 1. The receptacle 116 is fitted with a pointed piercing device 119, which extends all the way through the upper portion of the receptacle 116. The radial cross section of piercing device 119 is shaped like a cross as shown in FIG. 6*d*, so that air can move through the piercing device 119. The body member 11, having a cavity or chamber 511, now filled with liquid additive, is inserted into receptacle 116 and is turned one quarter turn so it attaches to the receptacle 116 and is held in place by tabs 115 as depicted in FIG. 7. When the body member 11 is inserted into the receptacle 116, the pointed end of piercing device 119 penetrates the adhesive foil 144, which covers aperture 44 and thus allows air to enter the cavity of body member 11, so that the additive contained in the body member 11 now can flow through flow restrictor 14. As the additive flows through flow restrictor 14, it appears as a film on the surface of the flow restrictor and is continuously washed away by the shower water without formation of droplets. The device described in this embodiment of the present invention is intended for use only one time and is disposed after use. However, the size can be adjusted so that the device can be used multiple times while still being disposable. Thus, in this case, the micro-porous flow restrictor is preferably made from an inexpensive material such as polyethylene or polypropylene or similar plastic materials. Since micro-porous structures made from polyethylene or similar polyolefins generally are very hydrophobic, direct exposure of the flow restrictor 14 by the shower water does not interfere with the flow of the additive through the flow restrictor. Therefore, it is unnecessary to cover the portion of the flow restrictor 14 that protrudes from the body member 11.

In use, the body member 11 is attached to receptacle 116 by inserting it into the receptacle and turning it a quarter turn. Body member 11 is then placed in a vertical position and in such a way that the flow restrictor 14 reaches into the water flowing from the showerhead. As the water washes away the thin film of additive on the surface of the flow restrictor 14, the additive is homogeneously mixed with the water. In one application of the device, the additive may be an aromatic oil or a mixture of aromatic oils. When the aromatic oil is mixed with the shower water, an aroma therapeutic effect is produced. When the liquid additive is exhausted, the body member 11 is removed from receptacle 116 and is discarded.

The rate by which the additive flows through the flow restrictor 14 is at its maximum when the dispenser 10 is in a vertical position with the flow restrictor 14 pointing down. Tilting the device to a position between vertical and horizontal reduces the flow rate. For instance, if the body member 11 is tilted to a position to form a 45-degree angle with the vertical position, the flow rate is reduced to approximately 70% of the flow rate that is achieved when the body member 11 is held in a vertical position. The body member 11 can be tilted into a horizontal position in which the flow is completely stopped. The flow rate can also be adjusted by moving the flow restrictor 14 further in or out of the body member 11. Generally, when the flow restrictor 14 is moved further into the body member 11, the flow rate increases and vice versa.

Figure 8:
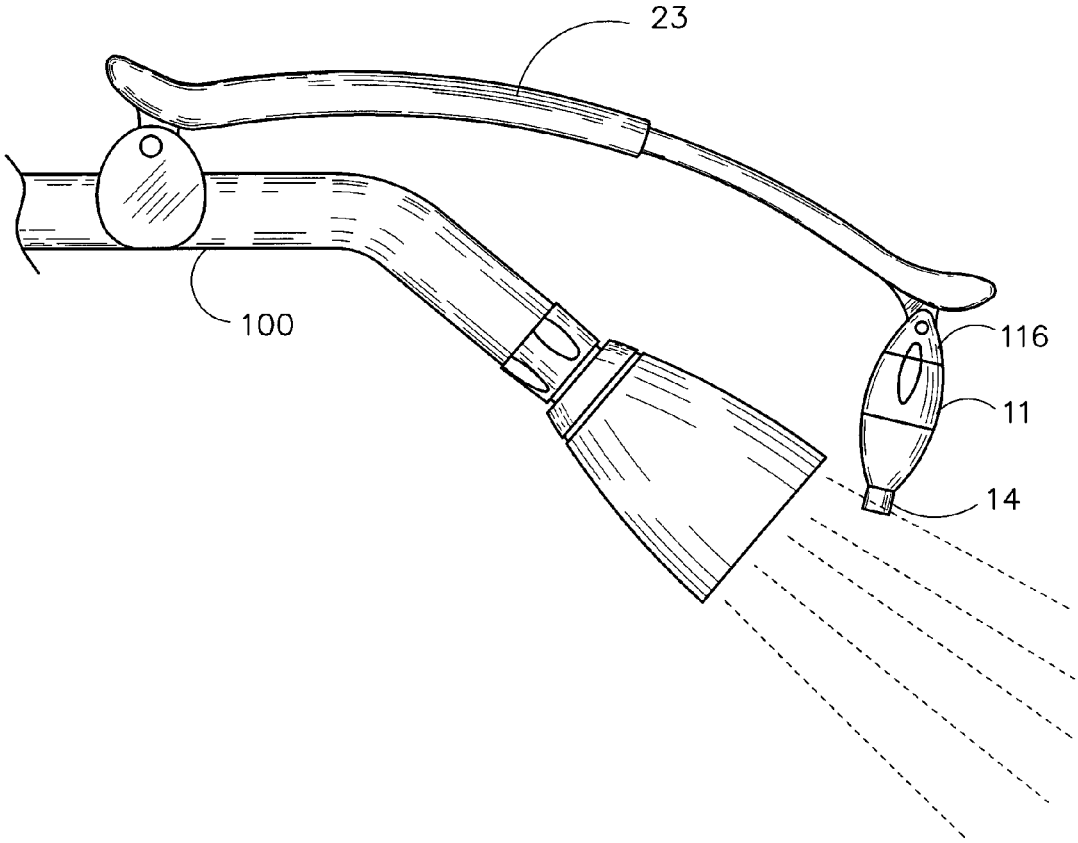
FIG. 8 is a perspective view of the shower additive dispenser according to the invention shown in FIG. 5*a* mounted on shower supply pipe.

FIG. 8 shows the dispenser 10 of the second embodiment mounted to a shower supply pipe 100. However, the arm 23 can just as easily be mounted to a wall surface of the shower. The dispenser includes an arm 23, which can be telescoping so as to allow a positioning of the body member 11. At the end of the arm 23 opposite its mounting to the shower/shower supply pipe, the receptacle 116 is mounted in a pivotable manner to the arm 23, using a pin or screw as indicated above.

I claim:

1. A shower additive dispenser assembly comprising:

an arm member;

a receptacle mounted to said arm member;

a body member having a cavity formed therein for retaining a fluid, said body member removably mounted to said receptacle;

a microporous flow restrictor disposed at said body member, said microporous flow restrictor configured for allowing the fluid to exit the body member, said microporous flow restrictor having a surface external with respect to said body member for allowing a passing liquid stream to wash the fluid from said surface of said microporous flow restrictor.

2. The assembly according to claim 1, wherein said receptacle is pivotably mounted to said arm member for controlling a rate flow of the fluid by defining the angle of said body member.

3. The assembly according to claim 2, wherein said body member has an end with an opening formed therein, said opening being sealed with a foil, said receptacle having a piercing device configured to pierce said foil when said body member is mounted to said receptacle.

4. The assembly according to claim 3, wherein said piercing device has a cross-shaped cross-section.

5. The assembly according to claim 3, wherein said body member is mounted to said receptacle with a bayonet-type connection.

6. The assembly according to claim 3, wherein said microporous flow restrictor is hydrophobic.

7. The assembly according to claim 3, wherein said microporous flow restrictor is selected from the group consisting of polyethylene and polypropylene.

8. The assembly according to claim 3, wherein said arm member is telescopic and is configured to be mounted to a shower supply pipe.

9. In combination with a receptacle having a piercing device a shower additive dispenser, comprising:

a body member having a cavity formed therein for retaining a fluid, said body member configured for being removably mounted to the receptacle, said body member having an aperture formed therein and communicating with said cavity, said aperture being configured for accepting the piercing device;

a seal sealing said aperture;

a microporous flow restrictor disposed at said body member and being constructed for allowing the fluid to flow from said cavity, said microporous flow restrictor having a surface external with respect to said body member for allowing a passing liquid stream to wash the fluid from said surface of said microporous flow restrictor.

10. The shower additive dispenser according to claim 9, wherein said seal is a foil affixed to said body member.

11. The shower additive dispenser according to claim 10, wherein said body member has tabs for mounting said body member to the receptacle.

12. The shower additive dispenser according to claim 11, wherein said microporous flow restrictor is hydrophobic.

13. The shower additive dispenser according to claim 11, wherein said microporous flow restrictor is selected from the group consisting of polyethylene and polypropylene.

14. The assembly according to claim 2, wherein said microporous flow restrictor is cylindrical, said microporous flow restrictor having a portion disposed in said cavity and a portion projecting from said body member.

15. The assembly according to claim 9, wherein said microporous flow restrictor is cylindrical, said microporous flow restrictor having a portion disposed in said cavity and a portion projecting from said body member.

16. In combination with a receptacle having a piercing device a shower additive dispenser, comprising:

a body member having a cavity formed therein for retaining a fluid, said body member configured for being removably mounted to the receptacle, said body member having a panel defined by a score, said panel being configured for being displaced by the piercing device thereby defining an aperture for communicating with said cavity;

a microporous flow restrictor disposed at said body member and being constructed for allowing the fluid to flow from said cavity, said microporous flow restrictor having a surface external with respect to said body member for allowing a passing liquid stream to wash the fluid from said surface of said microporous flow restrictor.

17. The assembly according to claim 1, wherein said microporous flow restrictor has a pore size of no greater than 90 microns.

18. The assembly according to claim 9, wherein said microporous flow restrictor has a pore size of no greater than 90 microns.

19. The assembly according to claim 16, wherein said microporous flow restrictor has a pore size of no greater than 90 microns.

20. The assembly according to claim 1, wherein said microporous flow restrictor is hydrophobic.

* * * * *